US010678168B1

(12) United States Patent
Furukawa et al.

(10) Patent No.: US 10,678,168 B1
(45) Date of Patent: Jun. 9, 2020

(54) BELT, INTERMEDIATE TRANSFER BELT, AND IMAGE FORMING APPARATUS

(71) Applicant: FUJI XEROX Co., Ltd., Tokyo (JP)

(72) Inventors: Masato Furukawa, Kanagawa (JP); Shigeru Fukuda, Kanagawa (JP); Satoya Sugiura, Kanagawa (JP); Futoshi Takei, Kanagawa (JP); Hiroaki Tanaka, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/584,109

(22) Filed: Sep. 26, 2019

(30) Foreign Application Priority Data

May 24, 2019 (JP) ..... 2019-097885

(51) Int. Cl.
*G03G 15/16* (2006.01)

(52) U.S. Cl.
CPC ..... *G03G 15/162* (2013.01)

(58) Field of Classification Search
USPC ..... 399/308
See application file for complete search history.

(56) References Cited

U.S. PATENT DOCUMENTS 7,953,355 B2 5/2011 Sawai
8,014,708 B2 9/2011 Sawai
2009/0148201 A1* 6/2009 Sawai ..... G03G 15/162 399/302

FOREIGN PATENT DOCUMENTS

JP 2009-139657 A 6/2009
JP 2010-026432 A 2/2010

* cited by examiner

*Primary Examiner* — Quana Grainger
(74) *Attorney, Agent, or Firm* — Sughrue Mion, PLLC

(57) ABSTRACT

A belt capable of holding a toner image, the belt being used for an image forming apparatus, includes a multilayer structure including a surface layer defining an outer peripheral surface of the belt. The belt has a 5-sec volume resistivity at 100 V of 10.0 log Ω·cm or more and 12.5 log Ω·cm or less. The outer peripheral surface of the belt has a 3-sec surface resistivity at 100 V of more than 11.0 log Ω/sq and 13.5 log Ω/sq or less. The difference between a 1-sec surface resistivity of the outer peripheral surface of the belt at 100 V and a 100-sec surface resistivity of the outer peripheral surface of the belt at 100 V is 0.5 or less.

20 Claims, 1 Drawing Sheet

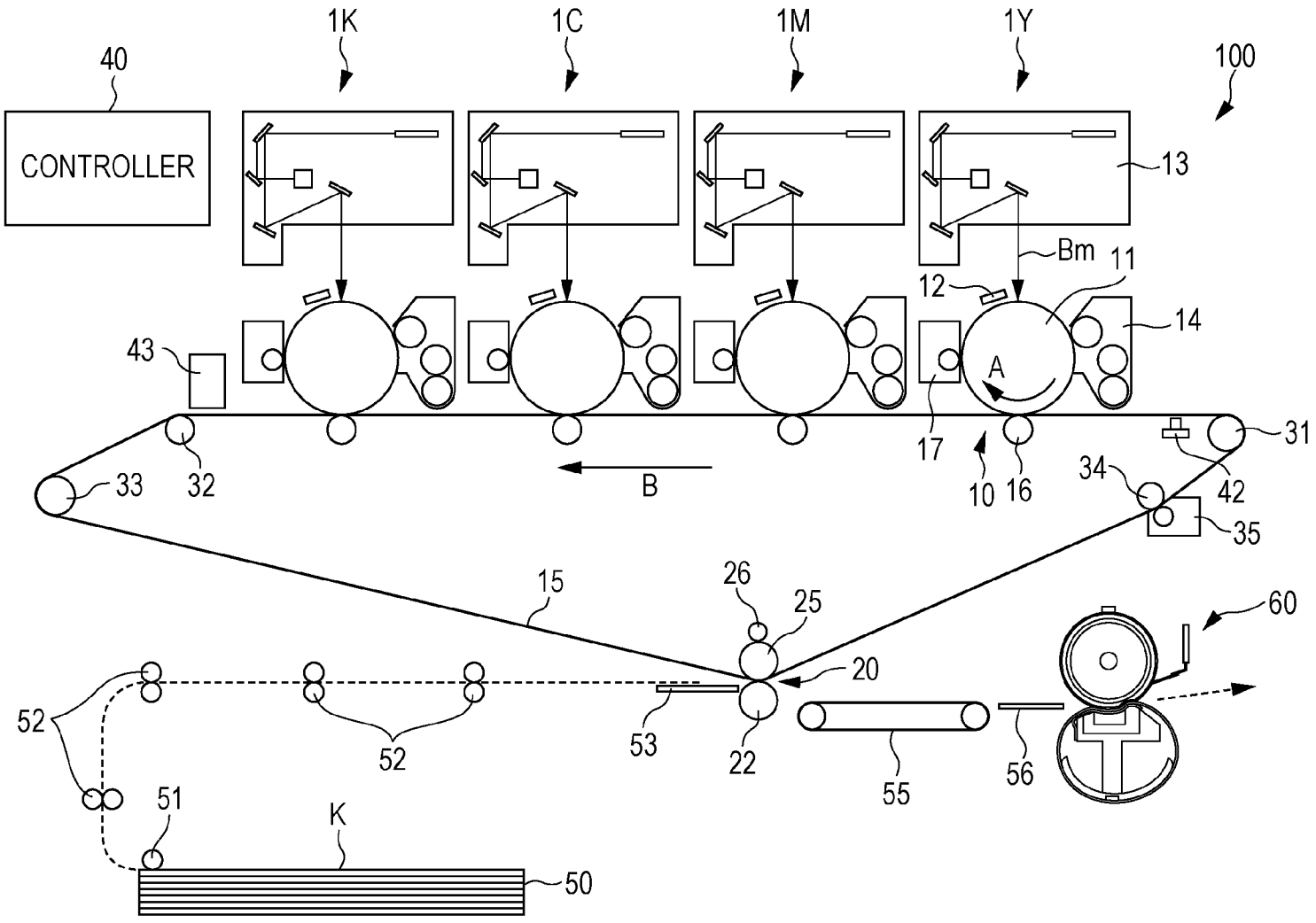
100
1Y
1M
1C
1K
13
14
11
Bm
12
A
16
10
17
31
42
35
34
60
56
55
20
25
26
22
53
B
15
50
52
K
51
52
32
33
43
40
CONTROLLER

BELT, INTERMEDIATE TRANSFER BELT, AND IMAGE FORMING APPARATUS

CROSS-REFERENCE TO RELATED APPLICATIONS

This application is based on and claims priority under 35 USC 119 from Japanese Patent Application No. 2019-097885 filed May 24, 2019.

BACKGROUND

(i) Technical Field

The present disclosure relates to a belt, an intermediate transfer belt, and an image forming apparatus.

(ii) Related Art

Electrophotographic image forming apparatuses (e.g., a copying machine, a facsimile, and a printer) form an image by transferring a toner image formed on the surface of an image holding member onto the surface of a recording medium and fixing the toner image to the recording medium. When the toner image is transferred to a recording medium, an electrically conductive belt, such as an intermediate transfer belt, is used.

For example, Japanese Laid Open Patent Application Publication No. 2010-026432 discloses a multilayer loop belt member for use in image forming apparatuses, the belt member including a high-resistance surface layer capable of holding a toner image. The common logarithm of the 10-sec surface resistivity of the rear surface (i.e., the inner surface of the loop) of the belt member at 500 V is 9.0 to 12.5 log(Ω/sq). A change in the surface resistivity of the front surface (i.e., the outer surface of the loop) of the belt member, that is, the common logarithm of the difference between the 100-sec and 1-sec surface resistivity values of the front surface, is 0.5 to 1.50 log(Ω/sq) at 100 V and 0.2 log(Ω/sq) or less at 500 V. A change in the surface resistivity of the rear surface of the belt member, that is, the common logarithm of the difference between the 100-sec and 1-sec surface resistivity values of the rear surface, is 0.1 log(Ω/sq) or less at 100 V and 500 V.

Japanese Laid Open Patent Application Publication No. 2009-139657 discloses a multilayer loop belt member for use in image forming apparatuses, the belt member including a high-resistance surface layer capable of holding a toner image. The common logarithm of the volume resistivity of the belt member is 8.0 log Ω·cm or more and 11.0 log Ω·cm or less. A change in the surface resistivity of the front surface (i.e., the outer surface of the loop) of the belt member, that is, the common logarithm of the difference between the 100-sec and 1-sec surface resistivity values of the front surface, is larger than a change in the surface resistivity of the rear surface (i.e., the inner surface of the loop) of the belt member, that is, the common logarithm of the difference between the 100-sec and 1-sec surface resistivity values of the rear surface, by 0.05 log(Ω/sq) or more.

SUMMARY

When an image is formed, with an image forming apparatus, on a recording medium having large surface irregularities, such as an embossed paper sheet, transferability may become degraded depending on the volume resistivity and surface resistivity of the belt that holds a toner image and the difference in surface resistivity due to the amount of time during which a voltage is applied to the belt.

Aspects of non-limiting embodiments of the present disclosure relate to a belt capable of achieving high transferability even when a recording medium having large surface irregularities is used, compared with the case where the 3-sec surface resistivity of the outer peripheral surface of the belt at 100 V is 11.0 log Ω/sq or less or is more than 13.5 log Ω/sq, the case where the 5-sec volume resistivity of the belt at 100 V is less than 10.0 log Ω·cm or is more than 12.5 log Ω·cm, or the case where the difference between the 1-sec and 100-sec surface resistivity values of the outer peripheral surface of the belt at 100 V is more than 0.5.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a belt capable of holding a toner image, the belt being used for an image forming apparatus, the belt including a multilayer structure including a surface layer defining an outer peripheral surface of the belt, the belt having a 5-sec volume resistivity at 100 V of 10.0 log Ω·cm or more and 12.5 log Ω·cm or less, the 5-sec volume resistivity at 100 V being measured after a lapse of 5 seconds since start of application of a voltage of 100 V, the outer peripheral surface of the belt having a 3-sec surface resistivity at 100 V of more than 11.0 log Ω/sq and 13.5 log Ω/sq or less, the 3-sec surface resistivity at 100 V being measured after a lapse of 3 seconds since start of application of a voltage of 100 V, the difference between a 1-sec surface resistivity of the outer peripheral surface of the belt at 100 V and a 100-sec surface resistivity of the outer peripheral surface of the belt at 100 V being 0.5 or less, the 1-sec surface resistivity being measured after a lapse of 1 second since start of application of a voltage of 100 V, the 100-sec surface resistivity being measured after a lapse of 100 seconds since start of application of a voltage of 100 V.

BRIEF DESCRIPTION OF THE DRAWINGS

Exemplary embodiments of the present disclosure will be described in detail based on the following FIGURE, wherein:

FIGURE is a schematic diagram illustrating an example of an image forming apparatus according to an exemplary embodiment.

DETAILED DESCRIPTION

Exemplary embodiments are described below. The following description and Examples below are intended to be illustrative of the exemplary embodiments and not restrictive of the scope of the exemplary embodiments.

In the exemplary embodiments, a numerical range expressed using "to" means the range specified by the minimum and maximum described before and after "to", respectively.

In the exemplary embodiments, when numerical ranges are described in a stepwise manner, the upper or lower limit of a numerical range may be replaced with the upper or lower limit of another numerical range, respectively. In the exemplary embodiments, the upper and lower limits of a numerical range may be replaced with the upper and lower limits described in Examples below.

The term "step" used herein refers not only to an individual step but also to a step that is not distinguishable from other steps but achieves the intended purpose of the step.

In the exemplary embodiments, when an exemplary embodiment is described with reference to a drawing, the structure of the exemplary embodiment is not limited to the structure illustrated in the drawing. The sizes of the members illustrated in the attached drawings are conceptual and do not limit the relative relationship among the sizes of the members.

Each of the components described in the exemplary embodiments may include plural types of substances that correspond to the component. In the exemplary embodiments, in the case where a composition includes plural substances that correspond to a component of the composition, the content of the component in the composition is the total content of the plural substances in the composition unless otherwise specified.

Belt

The inventors of the present disclosure conducted extensive studies focusing on the resistivity of the belt and found that setting the volume resistivity of the belt and the surface resistivity of the outer peripheral surface of the belt to fall within specific ranges and setting an upper limit to the change in the surface resistivity of the outer peripheral surface of the belt which occurs when the amount of time during which the voltage is applied is changed may enable high transferability to be achieved even when a recording medium having large surface irregularities is used.

A belt devised on the basis of the above findings is the belt according to the exemplary embodiment below.

The belt according to the exemplary embodiment is a belt capable of holding a toner image, the belt being used for an image forming apparatus, the belt including a multilayer structure including a surface layer defining an outer peripheral surface of the belt. The belt has a 5-sec volume resistivity at 100 V of 10.0 log Ω·cm or more and 12.5 log Ω·cm or less. The outer peripheral surface of the belt has a 3-sec surface resistivity at 100 V of more than 11.0 log Ω/sq and 13.5 log Ω/sq or less. The difference between a 1-sec surface resistivity of the outer peripheral surface of the belt at 100 V and a 100-sec surface resistivity of the outer peripheral surface of the belt at 100 V is 0.5 or less.

The belt according to the exemplary embodiment may achieve high transferability even when a recording medium having large surface irregularities is used.

Details of the belt according to the exemplary embodiment are described below.

The belt according to the exemplary embodiment is a belt for use in an image forming apparatus, the belt being capable of holding a toner image.

Examples of the belt capable of holding a toner image include an intermediate transfer belt. The belt according to the exemplary embodiment may be an open-end belt or an endless belt. The belt according to the exemplary embodiment may be a belt that includes a surface layer, a base layer, and a layer other than the surface layer or the base layer.

Volume Resistivity

The belt according to the exemplary embodiment has a 5-sec volume resistivity ρv at 100 V of 10.0 log Ω·cm or more and 12.5 log Ω·cm or less.

The 5-sec volume resistivity ρv at 100 V of the belt according to the exemplary embodiment is preferably 11.0 log Ω·cm or more and 12.5 log Ω·cm or less and is more preferably 11.7 log Ω·cm or more and 12.2 log Ω·cm or less.

The volume resistivity of the belt is determined by the following method.

The volume resistivity (log Ω·cm) of the belt is measured using a micro current meter "R8430A" produced by Advantest Corporation as a resistance meter and a UR probe produced by Mitsubishi Chemical Corporation as a probe at the center and both edges of the belt in the width direction for each of 6 positions spaced at regular intervals in the circumferential direction, that is, 18 positions in total, with an applied voltage of 100 V, a voltage application time of 5 seconds, and a pressure of 1 kgf. The average of the volume resistivity values is calculated. The above measurement is conducted at 22° C. and 55% RH.

The term "5-sec volume resistivity at 100 V" used herein refers to the volume resistivity of the belt which is measured after a lapse of 5 seconds since the start of application of a voltage of 100 V.

Surface Resistivity of Outer Peripheral Surface of Belt

The 3-sec surface resistivity ρs1 at 100 V of the outer peripheral surface of the belt according to the exemplary embodiment is more than 11.0 log Ω/sq and 13.5 log Ω/sq or less.

The 3-sec surface resistivity ρs1 at 100 V of the outer peripheral surface of the belt is preferably 11.5 log Ω/sq or more and 13.5 log Ω/sq or less and is more preferably 12.5 log Ω/sq or more and 13.3 log Ω/sq or less.

The difference between the 1-sec and 100-sec surface resistivity values at 100 V of the outer peripheral surface of the belt according to the exemplary embodiment, that is, [1-sec Surface resistivity at 100 V]− [100-sec Surface resistivity at 100 V], is 0.5 or less.

The above difference in surface resistivity is more preferably 0.3 or less and may be 0.

Surface Resistivity of Inner Peripheral Surface of Belt

In order to reduce discharging that may occur on the rear surface (i.e., a surface of the belt opposite to the outer peripheral surface: inner peripheral surface) of the belt as a result of electric charge accumulating at the rear surface of the belt during transfer, the 5-sec surface resistivity ρs2 at 500 V of the inner peripheral surface of the belt according to the exemplary embodiment is preferably 10.5 log Ω/sq or more and 13.0 log Ω/sq or less, is more preferably 12.0 log Ω/sq or more and 13.0 log Ω/sq or less, and is further preferably 12.0 log Ω/sq or more and 12.7 log Ω/sq or less.

The surface resistivity of the belt is determined by the following method.

The surface resistivity (log Ω/sq) of the belt is measured using a micro current meter "R8430A" produced by Advantest Corporation as a resistance meter and a UR probe produced by Mitsubishi Chemical Corporation as a probe at the center and both edges of the belt in the width direction for each of 6 positions spaced at regular intervals in the circumferential direction, that is, 18 positions in total, with an applied voltage of 100 or 500 V, a voltage application time of 1, 3, or 100 seconds, and a pressure of 1 kgf. The average of the surface resistivity values is calculated. The above measurement is conducted at 22° C. and 55% RH.

The term "3-sec surface resistivity at 100 V" used herein refers to the surface resistivity of the belt which is measured after a lapse of 3 seconds since the start of application of a voltage of 100 V. Similarly, the term "1-sec surface resistivity at 100 V" used herein refers to the surface resistivity of the belt which is measured after a lapse of 1 second since the start of application of a voltage of 100 V, the term "100-sec surface resistivity at 100 V" used herein refers to the surface resistivity of the belt which is measured after a lapse of 100 seconds since the start of application of a voltage of 100 V, and the term "5-sec surface resistivity at 500 V" used herein refers to the surface resistivity of the belt which is measured after a lapse of 5 seconds since the start of application of a voltage of 500 V.

When the UR probe is pressed against the outer peripheral surface of the belt, the surface resistivity ρs1 of the outer peripheral surface of the belt can be measured. Similarly, when the UR probe is pressed against a surface of the belt which is opposite to the outer peripheral surface (i.e., the inner peripheral surface of the belt), the surface resistivity ρs2 of the inner peripheral surface of the belt can be measured.

In order to achieve the above-described volume resistivity and surface resistivity of the belt according to the exemplary embodiment, the selection of the type of the resin included in the surface layer, the selection of the type of the conductant agent included in the surface layer, the selection of the particle sizes thereof, and adjustments to the amounts and proportions of the above constituents may be made adequately. The volume resistivity and surface resistivity of the belt may also be controlled by adjusting the distribution of the conductant agent particles in the surface layer.

The selection of the type of the resin included in a base layer arranged adjacent to the surface layer, the selection of the type of the conductant agent included in the base layer, the selection of the particle sizes thereof, and adjustments to the amounts and proportions of the above constituents may also be made adequately in order to readily control the volume resistivity and surface resistivity of the belt. The volume resistivity and surface resistivity of the belt may also be readily controlled by adjusting the distribution of the conductant agent particles in the base layer.

Surface Layer

The belt according to the exemplary embodiment includes a surface layer that defines the outer peripheral surface of the belt.

The surface layer may include at least one selected from the group consisting of a polyimide resin and a polyamideimide resin in order to increase mechanical strength and enhance the dispersibility of the conductant agent (e.g., carbon black). In particular, the surface layer may include a polyamideimide resin in order to increase the dispersibility of carbon black particles (specifically, the dispersibility of carbon black particles having smaller diameters).

The surface layer may include a conductant agent in order to adjust resistivity. In particular, the surface layer may include carbon black.

Polyamideimide Resin

The surface layer may include a polyamideimide resin.

The polyamideimide resin may be any resin including a repeating unit including an imide linkage and an amide linkage.

Specific examples of the polyamideimide resin include a polymer produced by polymerization of a trivalent carboxylic acid compound (i.e., tricarboxylic acid) having an acid anhydride group with a diisocyanate or diamine compound.

The tricarboxylic acid may be trimellitic anhydride or a derivative of trimellitic anhydride. The tricarboxylic acid may be used in combination with a tetracarboxylic dianhydride, an aliphatic dicarboxylic acid, an aromatic dicarboxylic acid, or the like.

Examples of the diisocyanate compound include 3,3'-dimethylbiphenyl-4,4'-diisocyanate, 2,2'-dimethylbiphenyl-4,4'-diisocyanate, biphenyl-4,4'-diisocyanate, biphenyl-3,3'-diisocyanate, biphenyl-3,4'-diisocyanate, 3,3'-diethylbiphenyl-4,4'-diisocyanate, 2,2'-diethylbiphenyl-4,4'-diisocyanate, 3,3'-dimethoxybiphenyl-4,4'-diisocyanate, 2,2'-dimethoxybiphenyl-4,4'-diisocyanate, naphthalene-1,5-diisocyanate, and naphthalene-2,6-diisocyanate.

Examples of the diamine compound include compounds that have a structure similar to that of any of the above isocyanates and include amino groups instead of isocyanato groups.

The surface layer may include only one type of polyamideimide resin or two or more types of polyamideimide resins.

The content of the polyamideimide resin in the surface layer is not limited and may be set such that the volume resistivity of the belt and the surface resistivity of the outer peripheral surface of the belt fall within the respective predetermined ranges described above. For example, the content of the polyamideimide resin in the surface layer is preferably 60% by mass or more and 95% by mass or less, is more preferably 70% by mass or more and 95% by mass or less, and is further preferably 75% by mass or more and 90% by mass or less of the total mass of the surface layer.

Carbon Black

The surface layer may include carbon black.

Since carbon black has a high electrical conductivity, carbon black is capable of increasing electrical conductivity to a high degree even when the amount of carbon black used is small.

Examples of the carbon black included in the surface layer include Ketjenblack, oil-furnace black, channel black, acetylene black, and surface-oxidized carbon black (hereinafter, referred to as "surface-treated carbon black"). Among these, surface-treated carbon black is preferable in terms of consistency of electric resistance over time.

Surface-treated carbon black particles may be produced by attaching a carboxyl group, a quinone group, a lactone group, a hydroxyl group, or the like to the surfaces of carbon black particles. Examples of a method for treating the surfaces of carbon black particles include an air oxidation method in which carbon black particles are brought into contact with air in a high-temperature atmosphere to cause a reaction, a method in which carbon black particles are caused to react with a nitrogen oxide or ozone at normal temperature (e.g., 22° C.), and a method in which air oxidation of carbon black particles is performed in a high-temperature atmosphere and the carbon black particles are oxidized using ozone at a low temperature.

The average primary particle size of the carbon black included in the surface layer is preferably 2 nm or more and 20 nm or less and is more preferably 5 nm or more and 20 nm or less in consideration of dispersibility and exposure of the carbon black particles at the surface.

In the exemplary embodiment, the average primary particle size of carbon black is determined by the following method.

A specimen having a thickness of 100 nm is taken from the belt with a microtome. The specimen is observed with a transmission electron microscope (TEM). For each of 50 carbon black particles, the diameter of a circle having an area equal to the projected area of the carbon black particle is calculated as the size of the carbon black particle. The average of the sizes of the 50 carbon black particles is considered the average primary particle size of carbon black.

The surface layer may include only one type of carbon black material or two or more types of carbon black materials.

The content of the carbon black in the surface layer is not limited and may be set such that the volume resistivity of the belt and the surface resistivity of the outer peripheral surface of the belt fall within the respective predetermined ranges described above. The content of the carbon black in the surface layer is preferably 5% by mass or more and 40% by mass or less, is more preferably 10% by mass or more and 30% by mass or less, and is further preferably 10% by mass or more and 22% by mass or less of the total mass of the surface layer.

Other Constituents

The surface layer may include a constituent other than the above-described constituents.

Examples of the other constituent include a conductant agent other than carbon black, a filler used for increasing the strength of the belt, an antioxidant used for preventing the belt from becoming degraded by heat, a surfactant used for improving fluidity, and a heat-resistant antioxidant.

In the case where the surface layer includes the other constituent, the content of the other constituent in the surface layer is preferably more than 0% by mass and 10% by mass or less, is more preferably more than 0% by mass and 5% by mass or less, and is further preferably more than 0% by mass and 1% by mass or less of the total mass of the surface layer.

Thickness

The thickness of the surface layer is preferably 1 μm or more and 40 μm or less and is more preferably 3 μm or more and 20 μm or less in order to increase ease of production and reduce discharging.

The thickness of the surface layer is determined by the following method.

A cross section of the belt taken in the thickness direction is observed with an optical microscope or a scanning electron microscope. The thickness of the surface layer is measured at 10 positions, and the average thereof is considered the thickness of the surface layer. This method applies also to the measurement of the thickness of the base layer, which is described below.

Base Layer

The belt according to the exemplary embodiment has a multilayer structure including the surface layer. The multilayer structure may include a base layer arranged adjacent to the surface layer. The base layer may be a layer that defines the inner peripheral surface of the belt.

The base layer may include at least one selected from the group consisting of a polyimide resin and a polyamideimide resin in order to increase mechanical strength and enhance the dispersibility of the conductant agent (e.g., carbon black). In particular, the base layer may include a polyimide resin in order to increase mechanical strength.

The base layer may include a conductant agent in order to adjust resistivity. In particular, the base layer may include carbon black.

Polyimide Resin

The base layer may include a polyimide-based resin.

The polyimide-based resin may be a polyimide resin or a polyamideimide resin and is preferably a polyimide resin in order to increase mechanical strength.

Examples of the polyimide resin include a polyimide resin produced by imidization of a polyamic acid (i.e., a precursor of a polyimide resin), which is a polymer produced by polymerization of a tetracarboxylic dianhydride with a diamine compound.

Examples of the polyimide resin include a resin including the structural unit represented by General Formula (I) below.

(I)

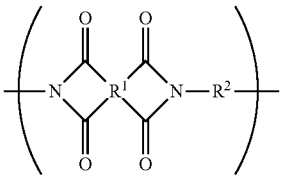

In General Formula (I), $R^1$ represents a tetravalent organic group and $R^2$ represents a divalent organic group.

Examples of the tetravalent organic group represented by $R^1$ include an aromatic group, an aliphatic group, a cyclic aliphatic group, a group that includes an aromatic group and an aliphatic group, and groups formed by substituting the above groups with a substituent. Specific examples of the tetravalent organic group include a residue of the tetracarboxylic dianhydride described below.

Examples of the divalent organic group represented by $R^2$ include an aromatic group, an aliphatic group, a cyclic aliphatic group, a group that includes an aromatic group and an aliphatic group, and groups formed by substituting the above groups with a substituent. Specific examples of the divalent organic group include a residue of the diamine compound described below.

Specific examples of the tetracarboxylic dianhydride used as a raw material for the polyimide resin include pyromellitic dianhydride, 3,3',4,4'-benzophenonetetracarboxylic dianhydride, 3,3',4,4'-biphenyltetracarboxylic dianhydride, 2,3,3',4-biphenyltetracarboxylic dianhydride, 2,3,6,7-naphthalenetetracarboxylic dianhydride, 1,2,5,6-naphthalenetetracarboxylic dianhydride, 1,4,5,8-naphthalenetetracarboxylic dianhydride, 2,2'-bis(3,4-dicarboxyphenyl)sulfonic dianhydride, perylene-3,4,9,10-tetracarboxylic dianhydride, bis(3,4-dicarboxyphenyl)ether dianhydride, and ethylenetetracarboxylic dianhydride.

Specific examples of the diamine compound used as a raw material for the polyimide resin include 4,4'-diaminodiphenyl ether, 4,4'-diaminodiphenylmethane, 3,3'-diaminodiphenylmethane, 3,3'-dichlorobenzidine, 4,4'-diaminodiphenyl sulfide, 3,3'-diaminodiphenylsulfone, 1,5-diaminonaphthalene, m-phenylenediamine, p-phenylenediamine, 3,3'-dimethyl-4,4'-biphenyldiamine, benzidine, 3,3'-dimethylbenzidine, 3,3'-dimethoxybenzidine, 4,4'-diaminodiphenyl sulfone, 4,4'-diaminodiphenylpropane, 2,4-bis(β-amino-tert-butyl)toluene, bis(p-β-amino-tert-butylphenyl)ether, bis(p-β-methyl-δ-aminophenyl)benzene, bis-p-(1,1-dimethyl-5-amino-pentyl)benzene, 1-isopropyl-2,4-m-phenylenediamine, m-xylylenediamine, p-xylylenediamine, di(p-aminocyclohexyl)methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis[4-(4-aminophenoxy)phenyl]propane, piperazine, $H_2N(CH_2)_3O(CH_2)_2O(CH_2)NH_2$, $H_2N(CH_2)_3S(CH_2)_3NH_2$, and $H_2N(CH_2)_3N(CH_3)_2(CH_2)_3NH_2$.

The base layer may include only one type of polyimide resin or two or more types of polyimide resins.

The content of the polyimide resin in the base layer is preferably 60% by mass or more and 95% by mass or less, is more preferably 70% by mass or more and 95% by mass or less, and is further preferably 70% by mass or more and 90% by mass or less of the total mass of the base layer in order to reduce discharging and increase the mechanical strength of the belt.

Carbon Black

The base layer may include carbon black in order to, for example, control the number of conducting points present on the belt according to the exemplary embodiment and the volume resistivity of the belt.

Examples of the carbon black included in the base layer include Ketjenblack, oil-furnace black, channel black, acetylene black, and the surface-treated carbon black, which are the same as the examples of the carbon black included in the surface layer. A preferable example of the carbon black included in the base layer is also the same as the preferable example of the carbon black included in the surface layer.

The average primary particle size of the carbon black included in the base layer is preferably 20 nm or more and 40 nm or less, is more preferably 20 nm or more and 35 nm or less, and is particularly preferably 20 nm or more and 28 nm or less in order to enhance dispersibility (in particular, dispersibility in a polyimide resin), increase the mechanical strength of the base layer, and make it easy to control the number of conducting points present on the belt and the volume resistivity of the belt.

The base layer may include only one type of carbon black material or two or more types of carbon black materials.

The content of the carbon black in the base layer is preferably 5% by mass or more and 40% by mass or less, is more preferably 10% by mass or more and 30% by mass or less, and is further preferably 20% by mass or more and 30% by mass or less of the total mass of the base layer in order to enhance dispersibility (in particular, dispersibility in a polyimide resin), increase the mechanical strength of the base layer, and make it easy to control the volume resistivity of the belt.

Other Constituents

The base layer may include a constituent other than the above-described constituents.

Examples of the other constituent include constituents that are the same as the other constituents of the surface layer.

In the case where the base layer includes the other constituent, the content of the other constituent in the base layer is preferably more than 0% by mass and 10% by mass or less, is more preferably more than 0% by mass and 5% by mass or less, and is further preferably more than 0% by mass and 1% by mass or less of the total mass of the base layer.

Thickness

The thickness of the base layer is preferably 50 μm or more and 100 μm or less and is more preferably 60 μm or more and 80 μm or less in order to increase the mechanical strength of the belt.

Overall Thickness

The overall thickness of the belt according to the exemplary embodiment is preferably 60 μm or more and 120 μm or less and is more preferably 80 μm or more and 100 μm or less in order to achieve high transferability even when a recording medium having large surface irregularities is used.

The ratio of the thickness of the surface layer to the overall thickness of the belt according to the exemplary embodiment is preferably 3% or more and 50% or less, is more preferably 3% or more and 30% or less, and is further preferably 5% or more and 30% or less in order to achieve high transferability even when a recording medium having large surface irregularities is used.

Method for Producing Belt

The method for producing the belt according to the exemplary embodiment is not limited and may be any method capable of forming the surface layer and the base layer such that the surface layer and the base layer are adjacent to each other.

One of the methods for producing the belt according to the exemplary embodiment is the following.

A coating liquid A that includes carbon black particles dispersed therein and a polyamic acid (i.e., a precursor of a polyimide resin) dissolved therein is prepared. A coating liquid B that includes carbon black particles dispersed therein and a polyamideimide resin dissolved therein is also prepared.

In the preparation of the coating liquids A and B, a dispersion treatment may be performed using a pulverizer, such as a jet mill, in order to disintegrate aggregates of carbon black and enhance the dispersibility of carbon black particles.

The coating liquid A is applied to a hollow or solid cylinder. The resulting coating film is dried to form a base layer. The coating liquid B is applied to the base layer, and the resulting coating film is dried to form a surface layer.

Imidization of the polyamic acid included in the coating liquid A is performed after the coating film formed of the coating liquid A has been dried or after the surface layer has been formed on the base layer. That is, heating for imidization may be performed after the coating film formed of the coating liquid A has been dried or after the surface layer has been formed on the base layer.

In the heating for imidization, for example, heating is performed at 150° C. or more and 450° C. or less (preferably 200° C. or more and 430° C. or less) for 20 minutes or more and 180 minutes or less (preferably 60 minutes or more and 150 minutes or less). This causes an imidization reaction to produce a polyimide.

The solvent used for preparing the coating liquids A and B is not limited and may be selected appropriately in accordance with the resin and the like that are to be dissolved in the solvent. For example, the solvent used for preparing the coating liquids A and B may be the polar solvent described below.

Although the base layer is formed by coating in the above method, alternatively, the base layer may be formed by the following method:

a method in which a pellet including a polyimide resin and carbon black is prepared and the pellet is melt-extruded to form a base layer.

Examples of the polar solvent include N-methyl-2-pyrrolidone (NMP), N,N-dimethylformamide (DMF), N,N-dimethylacetamide (DMAc), N,N-diethylacetamide (DEAc), dimethyl sulfoxide (DMSO), hexamethylphosphoramide (HMPA), N-methylcaprolactam, N-acetyl-2-pyrrolidone, and 1,3-dimethyl-2-imidazolidinone (N,N-dimethylimidazolidinone, DMI). The above polar solvents may be used alone or in combination of two or more.

Image Forming Apparatus

An image forming apparatus according to an exemplary embodiment includes the belt according to the above-described exemplary embodiment.

Specifically, the image forming apparatus according to the exemplary embodiment includes an image holding member; a charging device that charges the surface of the image holding member; an electrostatic-latent image formation device that forms an electrostatic latent image on the charged surface of the image holding member; a developing device that includes a developer including a toner and develops the electrostatic latent image formed on the surface of the image holding member with the developer to form a toner image; a transfer device that transfers the toner image onto the surface of a recording medium; and the belt according to the above-described exemplary embodiment.

The image forming apparatus according to the exemplary embodiment is described below with reference to the attached drawing.

FIGURE is a schematic diagram illustrating the image forming apparatus according to the exemplary embodiment. The example of the image forming apparatus illustrated in FIGURE includes the belt according to the exemplary embodiment which serves as an intermediate transfer belt.

Using the belt according to the exemplary embodiment as an intermediate transfer belt may limit degradation of transferability even when a recording medium having large surface irregularities, such as an embossed paper sheet, is used and reduce the formation of white spots at recesses.

An image forming apparatus 100 according to the exemplary embodiment is, for example, an intermediate-transfer image forming apparatus illustrated in FIGURE, which is commonly referred to as a tandem image forming apparatus. The image forming apparatus 100 includes a plurality of image formation units 1Y, 1M, 1C, and 1K that form yellow (Y), magenta (M), cyan (C), and black (K) toner images by an electrophotographic system; a first transfer section 10 in which the yellow, magenta, cyan, and black toner images formed by the image formation units 1Y, 1M, 1C, and 1K are sequentially transferred (first transfer) to an intermediate transfer belt 15; a second transfer section 20 in which the superimposed toner images transferred on the intermediate transfer belt 15 are collectively transferred (second transfer) to a paper sheet K, which is a recording medium; and a fixing device 60 that fixes the image transferred on the paper sheet K by second transfer to the paper sheet K. The image forming apparatus 100 also includes a controller 40 that controls the operation of each of the devices and the sections.

Each of the image formation units 1Y, 1M, 1C, and 1K included in the image forming apparatus 100 includes a photosensitive member 11 that rotates in the direction of the arrow A, which is an example of the image holding member that holds a toner image formed on the surface.

The photosensitive member 11 is provided with a charger 12 and a laser exposure machine 13 disposed on the periphery of the photosensitive member 11. The charger 12 (an example of a charging unit) charges the photosensitive member 11. The laser exposure machine 13 (an example of a latent image formation unit) writes an electrostatic latent image on the photosensitive member 11 (in FIGURE, an exposure beam is denoted with Bm).

The photosensitive member 11 is also provided with a developing machine 14 and a first-transfer roller 16 disposed on the periphery of the photosensitive member 11. The developing machine 14 (an example of a developing unit) includes a yellow, magenta, cyan, or black toner and visualizes the electrostatic latent image formed on the photosensitive member 11 with the toner. The first-transfer roller 16 transfers the yellow, magenta, cyan, or black toner image formed on the photosensitive member 11 to the intermediate transfer belt 15 in the first transfer section 10.

The photosensitive member 11 is further provided with a photosensitive member cleaner 17 disposed on the periphery of the photosensitive member 11. The photosensitive member cleaner 17 removes toner particles remaining on the photosensitive member 11. The above-described electrophotographic devices, that is, the charger 12, the laser exposure machine 13, the developing machine 14, the first-transfer roller 16, and photosensitive member cleaner 17, are sequentially arranged on the periphery of the photosensitive member 11 in the direction of the rotation of the photosensitive member 11. The image formation units 1Y, 1M, 1C, and 1K are arranged in a substantially linear manner in the order of yellow (Y), magenta (M), cyan (C), and black (K) in the direction of the rotation of the intermediate transfer belt 15.

The intermediate transfer belt 15, which serves as an intermediate transfer body, has a volume resistivity of, for example, $1\times10^{6}$ Ωcm or more and $1\times10^{14}$ Ωcm or less and a thickness of, for example, about 0.1 mm.

The intermediate transfer belt 15 is driven in a circulatory manner (i.e., rotated), by various types of rollers at an intended speed in the direction of the arrow B illustrated in FIGURE. The various types of rollers include a driving roller 31 that is driven by a highly-constant-speed motor (not illustrated) and rotates the intermediate transfer belt 15; a support roller 32 that supports the intermediate transfer belt 15 that extends in a substantially linear manner in the direction in which the photosensitive members 11 are arranged; a tension roller 33 that applies tension to the intermediate transfer belt 15 and serves as a correction roller that prevents meandering of the intermediate transfer belt 15; a backing roller 25 disposed in the second transfer section 20; and a cleaning backing roller 34 disposed on a cleaning section in which toner particles remaining on the intermediate transfer belt 15 are scraped off.

The first transfer section 10 is constituted by first-transfer rollers 16 that are arranged to face the respective photosensitive members 11 across the intermediate transfer belt 15. The first-transfer rollers 16 are arranged to be in pressure contact with the photosensitive members 11 with the intermediate transfer belt 15 interposed between the first-transfer rollers 16 and the photosensitive members 11. The first-transfer rollers 16 are supplied with a voltage (first transfer bias) having a polarity opposite to the polarity (negative; the same applies hereinafter) of charged toner particles. Accordingly, a transfer electric field is generated in the first transfer section 10, and toner images formed on the photosensitive members 11 are electrostatically attracted to the intermediate transfer belt 15 sequentially to form superimposed toner images on the intermediate transfer belt 15.

The second transfer section 20 is constituted by the backing roller 25 and a second transfer roller 22 disposed on a side of the intermediate transfer belt 15 on which the toner image is held.

The backing roller 25 has a surface resistivity of $1\times10^{7}$ Ω/sq or more and $1\times10^{10}$ Ω/sq or less. The degree of hardness of the backing roller 25 is set to, for example, 70° ("ASKER C" produced by KOBUNSHI KEIKI CO., LTD.; the same applies hereinafter). The backing roller 25 is disposed on the rear surface-side of the intermediate transfer belt 15 and serves as a counter electrode for the second transfer roller 22. The backing roller 25 is provided with a power feed roller 26 made of a metal, through which a second transfer bias is applied in a consistent manner.

The second transfer roller 22 is a hollow cylindrical roller having a volume resistivity of $10^{7.5}$ Ωcm or more and $10^{8.5}$ Ωcm or less. The second transfer roller 22 is arranged to be in pressure contact with the backing roller 25 with the intermediate transfer belt 15 interposed between the second transfer roller 22 and the backing roller 25. The second transfer roller 22 is grounded. A second transfer bias is applied between the second transfer roller 22 and the backing roller 25. Accordingly, a transfer electric field is generated in the second transfer section 20, and the toner image formed on the intermediate transfer belt 15 is transferred (second transfer) to a paper sheet K transported to the second transfer section 20.

An intermediate transfer belt cleaner 35 is disposed on the intermediate transfer belt 15 at a position downstream of the second transfer section 20 such that the distance between the intermediate transfer belt cleaner 35 and the intermediate transfer belt 15 can be changed. The intermediate transfer belt cleaner 35 removes toner particles and paper dust particles that remain on the intermediate transfer belt 15 subsequent to the second transfer and cleans the surface of the intermediate transfer belt 15.

The intermediate transfer belt 15, the first transfer section 10 (i.e., the first-transfer rollers 16), and the second transfer section 20 (i.e., the second transfer roller 22) correspond to examples of the transfer unit.

A reference sensor (home position sensor) 42 is disposed upstream of the yellow image formation unit 1Y. The reference sensor (home position sensor) 42 generates a reference signal used as a reference to determine the timings at which images are formed in the image formation units 1Y, 1M, 1C, and 1K. An image density sensor 43 is disposed downstream of the black image formation unit 1K. The image density sensor 43 is used for adjusting image quality. The reference sensor 42 generates the reference signal upon recognizing a mark disposed on the back side of the intermediate transfer belt 15. Upon recognizing the reference signal, the controller 40 sends a command to the image formation units 1Y, 1M, 1C, and 1K. Each of the image formation units 1Y, 1M, 1C, and 1K starts forming an image in accordance with the command.

The image forming apparatus according to the exemplary embodiment further includes the following components as units for transporting paper sheets K: a paper tray 50 that contains paper sheets K; a paper feed roller 51 that draws and transports a paper sheet K stocked in the paper tray 50 at predetermined timings; transport rollers 52 that transport the paper sheet K drawn by the paper feed roller 51; a transport guide 53 with which the paper sheet K transported by the transport rollers 52 is fed into the second transfer section 20; a transport belt 55 that transports the paper sheet K that has been subjected to the second transfer with the second transfer roller 22 to the fixing device 60; and a fixing entrance guide 56 with which the paper sheet K is introduced into the fixing device 60.

A fundamental process for forming an image using the image forming apparatus according to the exemplary embodiment is described below.

In image forming apparatus according to the exemplary embodiment, image data sent from an image reading apparatus (not illustrated), a personal computer (PC, not illustrated), or the like are subjected to image processing using an image processing apparatus (not illustrated) and, subsequently, the image formation units 1Y, 1M, 1C, and 1K form images.

In the image processing apparatus, the input reflectance data are subjected to image processing that includes various types of image editing, such as shading correction, misalignment correction, lightness/color space conversion, gamma correction, frame removal, color editing, and image moving. The image data that have been subjected to the image processing are converted into yellow, magenta, cyan, and black colorant gradation data and sent to the laser exposure machines 13.

In accordance with the colorant gradation data received by each of the laser exposure machines 13, the laser exposure machine 13 irradiates the photosensitive member 11 included in each of the image formation units 1Y, 1M, 1C, and 1K with an exposure beam Bm emitted from a semiconductor laser or the like. After the surface of the photosensitive member 11 of each of the image formation units 1Y, 1M, 1C, and 1K has been charged by the charger 12, the surface of the photosensitive member 11 is scanned by the laser exposure machine 13 and exposed to the beam and, consequently, an electrostatic latent image is formed on the surface of the photosensitive member 11. The electrostatic latent image is developed in each of the image formation units 1Y, 1M, 1C, and 1K as Y, M, C, or K toner image.

The toner images formed on the photosensitive members 11 of the image formation units 1Y, 1M, 1C, and 1K are transferred to the intermediate transfer belt 15 in the first transfer section 10 in which the photosensitive members 11 come into contact with the intermediate transfer belt 15. Specifically, in the first transfer section 10, the first-transfer rollers 16 apply a voltage (first transfer bias) having a polarity opposite to the polarity (negative) of charged toner particles to the base of the intermediate transfer belt 15 and the toner images are sequentially superimposed on the surface of the intermediate transfer belt 15 (first transfer).

After the toner images have been sequentially transferred (first transfer) onto the surface of the intermediate transfer belt 15, the intermediate transfer belt 15 is moved and the toner images are transported to the second transfer section 20. When the toner images are transported to the second transfer section 20, in the transport unit, the paper feed roller 51 starts rotating and feeds a paper sheet K having an intended size from the paper tray 50 in synchronization with the transportation of the toner images to the second transfer section 20. The paper sheet K fed by the paper feed roller 51 is transported by the transport rollers 52 and reaches the second transfer section 20 through the transport guide 53. Before the paper sheet K reaches the second transfer section 20, the feeding of the paper sheet K is temporarily paused and an alignment between the paper sheet K and the toner images is made by an alignment roller (not illustrated) being rotated in synchronization with the movement of the intermediate transfer belt 15 on which the toner images are held.

In the second transfer section 20, the second transfer roller 22 is pressed by the backing roller 25 with the intermediate transfer belt 15 interposed between the second transfer roller 22 and the backing roller 25. The paper sheet K transported to the second transfer section 20 at the intended timing becomes inserted between the intermediate transfer belt 15 and the second transfer roller 22. Upon a voltage (second transfer bias) having a polarity that is the same as the polarity (negative) of charged toner particles being applied by the power feed roller 26, a transfer electric field is generated between the second transfer roller 22 and the backing roller 25. The unfixed toner images held on the intermediate transfer belt 15 are electrostatically transferred to the paper sheet K collectively in the second transfer section 20, which is pressurized by the second transfer roller 22 and the backing roller 25.

The paper sheet K on which the toner images have been electrostatically transferred is subsequently removed from the intermediate transfer belt 15 and immediately transported by the second transfer roller 22 to the transport belt 55, which is disposed downstream of the second transfer roller 22 in the direction in which paper sheets are transported. The transport belt 55 transports the paper sheet K to the fixing device 60 in accordance with the transportation speed optimum for the fixing device 60. The unfixed toner images present on the paper sheet K transported to the fixing device 60 are fixed to the paper sheet K by heat and pressure in the fixing device 60. The paper sheet K on which the fixed image has been formed is transported to a paper eject tray (not illustrated) disposed in an ejecting section of the image forming apparatus.

Toner particles that remain on the intermediate transfer belt 15 after the termination of the transfer to the paper sheet K are transported to the cleaning section due to the rotation of the intermediate transfer belt 15 and removed from the intermediate transfer belt 15 by the cleaning backing roller 34 and the intermediate transfer belt cleaner 35.

The exemplary embodiments are described above. It should be understood that the above-described exemplary embodiments are not restrictive, and many modifications, variations, and improvements may be made to the exemplary embodiments.

EXAMPLES

Examples of the present disclosure are described below. Note that, the present disclosure is not limited by Examples below. In the following description, "part" and "%" are all on a mass basis.

Example 1

Preparation of Coating Liquid A

Carbon black "SPECIAL Black 4 (average primary particle size: 25 nm) produced by Orion Engineered Carbons is added to a N-methyl-2-pyrrolidone (NMP) solution of a polyamide acid including biphenyltetracarboxylic dianhydride (BPDA) and p-phenylenediamine (PDA) ("U-IMIDE KX" produced by Unitika Ltd., solid component concentration: 20 mass %) such that the ratio of the amount of carbon black to the total solid content in the coating liquid A is 20% by mass or more and 30% by mass or less. The resulting mixture is dispersed with a jet mill disperser "GeanusPY" produced by Geanus (200 N/mm, 2.5 passes).

The carbon black-dispersed polyamide acid solution is passed through a 20-μm stainless steel mesh in order to remove foreign matter and aggregates of carbon black. While the solution is further stirred, the solution is degassed by vacuum for 15 minutes. Hereby, a coating liquid A is prepared.

Preparation of Coating Liquid B

Carbon black "COLOR BLACK FW1" (average primary particle size: 13 nm) produced by Orion Engineered Carbons is added to a solution of a solvent-soluble polyamideimide resin (acid value: 8.0 mgKOH/g, solid component concentration: 18 mass %, solvent: N-methyl-2-pyrrolidone) such that the ratio of the amount of carbon black to the total solid content in the coating liquid B is 10% by mass or more and 22% by mass or less. The resulting mixture is dispersed with a jet mill disperser "GeanusPY" produced by Geanus (200 N/mm, 2.5 passes).

The carbon black-dispersed polyamideimide resin solution is passed through a 20-μm stainless steel mesh in order to remove foreign matter and aggregates of carbon black. While the solution is further stirred, the solution is degassed by vacuum for 15 minutes. Hereby, a coating liquid B is prepared.

Formation of Base Layer

A hollow cylinder having an outside diameter of 929.5 mm is prepared.

While the cylinder is rotated, the coating liquid A is applied onto the outer surface of the cylinder by spiral coating. Subsequently, while the cylinder is held horizontally, drying is performed at 90° C. for 30 minutes. Then, the resulting coating film is heated at 320° C. for 2 hours to form a base layer having a length of 350 mm and a thickness of 75 μm.

Formation of Surface Layer

While the cylinder is rotated, the coating liquid B is applied, by spiral coating, to the base layer prepared in the above-described manner. Subsequently, while the cylinder is held horizontally, drying is performed at 90° C. for 30 minutes. Then, the resulting coating film is heated at 260° C. for 2 hours to form a surface layer having a length of 350 mm and a thickness of 5 μm.

The surface layer and the base layer are removed from the cylinder. Hereby, a belt of Example 1 is prepared.

Examples 2 to 4

Belts of Examples 2 to 4 are prepared as in Example 1, except that the contents of carbon black in the coating liquids A and B are changed appropriately within the above-described ranges.

Example 5

A belt of Example 5 is prepared as in Example 1, except that the contents of carbon black in the coating liquids A and B are changed within the above-described ranges and the thickness of the base layer is changed to 115 μm.

Example 6

A belt of Example 6 is prepared as in Example 1, except that the contents of carbon black in the coating liquids A and B are changed within the above-described ranges, the thickness of the base layer is changed to 40 μm, and the thickness of the surface layer is changed to 40 μm.

Example 7

A belt of Example 7 is prepared as in Example 1, except that the contents of carbon black in the coating liquids A and B are changed within the above-described ranges and the thickness of the surface layer is changed to 15 μm.

Example 8

A belt of Example 8 is prepared as in Example 1, except that a coating liquid C prepared in the following manner is used instead of the coating liquid B for forming the surface layer.

Preparation of Coating Liquid C Carbon black "COLOR BLACK FW1" (average primary particle size: 13 nm) produced by Orion Engineered Carbons is added to a N-methyl-2-pyrrolidone (NMP) solution of a polyamide acid including biphenyltetracarboxylic dianhydride (BPDA) and p-phenylenediamine (PDA) ("U-IMIDE KX" produced by Unitika Ltd., solid component concentration: 20 mass %) such that the ratio of the amount of carbon black to the total solid content in the coating liquid C is 10% by mass or more and 22% by mass or less. The resulting mixture is dispersed with a jet mill disperser "GeanusPY" produced by Geanus (200 N/mm, 2.5 passes).

The carbon black-dispersed polyamide acid solution is passed through a 20-μm stainless steel mesh in order to remove foreign matter and aggregates of carbon black. While the solution is further stirred, the solution is degassed by vacuum for 15 minutes. Hereby, a coating liquid C is prepared.

Comparative Examples 1 to 6

Belts of Comparative examples 1 to 6 are prepared as in Example 1, except that the contents of carbon black in the coating liquids A and B are changed within the above-described ranges.

Comparative Example 7

A belt of Comparative example 7 is prepared as in Example 1, except that the contents of carbon black in the coating liquids A and B are changed within the above-described ranges and the thickness of the base layer is changed to 140 μm.

Comparative Example 8

A belt of Comparative example 8 is prepared as in Example 1, except that the contents of carbon black in the coating liquids A and B are changed within the above-described ranges and the thickness of the surface layer is changed to 10 μm.

Comparative Example 9

A belt of Comparative example 9 is prepared as in Example 1, except that a coating liquid D prepared in the following manner is used instead of the coating liquid B for forming the surface layer.

Preparation of Coating Liquid D Carbon black "SPECIAL Black 4 (average primary particle size: 25 nm) produced by Orion Engineered Carbons is added to a solution of a solvent-soluble polyamideimide resin (acid value: 8.0 mgKOH/g, solid component concentration: 18 mass %, solvent: N-methyl-2-pyrrolidone) such that the ratio of the amount of carbon black to the total solid content in the coating liquid D is 10% by mass or more and 22% by mass or less. The resulting mixture is dispersed with a jet mill disperser "GeanusPY" produced by Geanus (200 N/mm, 2.5 passes).

The carbon black-dispersed polyamideimide resin solution is passed through a 20-μm stainless steel mesh in order to remove foreign matter and aggregates of carbon black. While the solution is further stirred, the solution is degassed by vacuum for 15 minutes. Hereby, a coating liquid D is prepared.

Comparative Examples 10 and 11

Belts of Comparative examples 10 and 11 are prepared as in Example 1, except that the content of carbon black in the coating liquid A is changed within the above-described range, a base layer having a thickness of 33 μm is formed using the coating liquid A, and a surface layer having a thickness of 67 μm is formed on the base layer by using the coating liquid A instead of the coating liquid B, after the content of carbon black in the coating liquid A has been changed within the above-described range.

Measurement and Evaluation

Each of the belts prepared in Examples is subjected to the following measurement and evaluation.

Table 1 summarizes the results.

The volume resistivity and surface resistivity of each of the belts prepared in Examples are measured by the above-described methods. Specifically, the following values (1) to (4) are determined.

(1) The 5-sec volume resistivity at 100 V (denoted as "ρv(100V, 5 sec)" in Table 1)

(2) The 3-sec surface resistivity of the outer peripheral surface of the belt at 100 V (denoted as "ρs1(100V, 3 sec)" in Table 1)

(3) The difference between the 1-sec and 100-sec surface resistivity values of the outer peripheral surface of the belt at 100 V (denoted as "ρs1[100VΔ(100 sec−1 sec)]" in Table 1)

(4) The 10-sec surface resistivity of the inner peripheral surface of the belt at 500 V (denoted as "ρs2(500V, 10 sec)" in Table 1)

The thicknesses of the layers included in each of the belts prepared in Examples and the overall thickness of the belt are also measured by the above-described method.

Evaluation of Transferability to Embossed Paper

The belt prepared in each of Examples is used as an intermediate transfer belt and evaluated in terms of transfer efficiency in the following manner.

The intermediate transfer belt is attached to "Iridesse (registered trademark) Production Press" produced by Fuji Xerox Co., Ltd. and subjected to an image quality evaluation.

In the image quality evaluation, an embossed paper sheet "LEATHAC 66" (250 gsm) is used. A solid image of black halftone (image density: 60%) is evaluated.

G1: White spots are absent at the recesses on the paper sheet.

G2: Few white spots are present at the recesses on the paper sheet.

G3: White spots are slightly present at the recesses on the paper sheet.

G4: White spots are present at most of the recesses on the paper sheet.

Table 1 summarizes the results.

TABLE 1

| | Base layer | | | Surface layer | | | | Surface layer | ρv | ρs1 | ρs1 | ρs2 | |
|---|---|---|---|---|---|---|---|---|---|---|---|---|---|
| | Carbon black | | | Carbon black | | | | thickness/ | (100 V, | (100 V, | [100 V, | (500 V, | Transfer- |
| | Composition | Particle size [nm] | Thickness [μm] | Composition | Particle size [nm] | Thickness [μm] | Overall thickness [μm] | overall thickness × 100 [%] | 5 sec) [logΩ · cm] | 3 sec) [logΩ/sq] | Δ(100 sec-1 sec)] | 10 sec) [logΩ/sq] | ability to embossed paper |
| Example 1 | PI + CB | 25 | 75 | PAI + CB | 13 | 5 | 80 | 6.3% | 10.2 | 11.1 | 0.0 | 10.6 | G2 |
| Example 2 | PI + CB | 25 | 75 | PAI + CB | 13 | 5 | 80 | 6.3% | 12.1 | 13.2 | 0.5 | 12.7 | G1 |
| Example 3 | PI + CB | 25 | 75 | PAI + CB | 13 | 5 | 80 | 6.3% | 11.8 | 13.0 | 0.2 | 12.2 | G1 |
| Example 4 | PI + CB | 25 | 75 | PAI + CB | 13 | 5 | 80 | 6.3% | 11.3 | 11.8 | 0.4 | 11.6 | G2 |
| Example 5 | PI + CB | 25 | 115 | PAI + CB | 13 | 5 | 120 | 4.2% | 11.6 | 11.8 | 0.4 | 11.4 | G2 |
| Example 6 | PI + CB | 25 | 40 | PAI + CB | 13 | 40 | 80 | 50.0% | 12.2 | 12.2 | 0.3 | 12.4 | G2 |
| Example 7 | PI + CB | 25 | 75 | PAI + CB | 13 | 15 | 90 | 16.7% | 12.4 | 13.3 | 0.2 | 12.2 | G2 |
| Example 8 | PI + CB | 25 | 75 | PI + CB | 13 | 5 | 80 | 6.3% | 11.0 | 11.0 | 0.3 | 11.2 | G2 |

TABLE 1-continued

| | Base layer | | | Surface layer | | | | Surface layer | ρv | ρs1 | ρs1 | ρs2 | |
|---|---|---|---|---|---|---|---|---|---|---|---|---|---|
| | Carbon black | | | Carbon black | | | | thickness/ | (100 V, | (100 V, | [100 V, | (500 V, | Transfer- |
| | Compo-sition | Particle size [nm] | Thick-ness [μm] | Compo-sition | Particle size [nm] | Thick-ness [μm] | Overall thickness [μm] | overall thickness × 100 [%] | 5 sec) [logΩ · cm] | 3 sec) [logΩ/sq] | Δ(100 sec-1 sec)] | 10 sec) [logΩ/sq] | ability to embossed paper |
| Comparative example 1 | PI + CB | 25 | 75 | PAI + CB | 13 | 5 | 80 | 6.3% | 12.0 | 11.3 | 0.7 | 10.4 | G3 |
| Comparative example 2 | PI + CB | 25 | 75 | PAI + CB | 13 | 5 | 80 | 6.3% | 10.6 | 11.0 | 0.1 | 10.4 | G3 |
| Comparative example 3 | PI + CB | 25 | 75 | PAI + CB | 13 | 5 | 80 | 6.3% | 13.0 | 11.4 | 2.1 | 10.4 | G3 |
| Comparative example 4 | PI + CB | 25 | 75 | PAI + CB | 13 | 5 | 80 | 6.3% | 10.0 | 10.3 | 0.0 | 9.7 | G3 |
| Comparative example 5 | PI + CB | 25 | 75 | PAI + CB | 13 | 5 | 80 | 6.3% | 9.5 | 10.2 | 0.0 | 9.6 | G4 |
| Comparative example 6 | PI + CB | 25 | 75 | PAI + CB | 13 | 5 | 80 | 6.3% | 9.8 | 10.3 | 1.0 | 9.9 | G4 |
| Comparative example 7 | PI + CB | 25 | 140 | PAI + CB | 13 | 5 | 145 | 3.4% | 11.8 | 12.0 | 1.3 | 11.4 | G4 |
| Comparative example 8 | PI + CB | 25 | 75 | PAI + CB | 13 | 10 | 85 | 11.8% | 13.0 | 11.5 | 2.4 | 11.0 | G3 |
| Comparative example 9 | PI + CB | 25 | 75 | PAI + CB | 25 | 5 | 80 | 6.3% | 11.9 | 11.2 | 2.4 | 10.4 | G4 |
| Comparative example 10 | PI + CB | 25 | 33 | PI + CB | 25 | 67 | 100 | 67.0% | 12.6 | 13.5 | 0.3 | 13.0 | G4 |
| Comparative example 11 | PI + CB | 25 | 33 | PI + CB | 25 | 67 | 100 | 67.0% | 13.7 | 13.4 | 1.9 | 10.8 | G4 |

Details of the abbreviations used in Table 1 are described below.

PAI: Polyamideimide resin

PI: Polyimide resin

CB: Carbon black

The results described in Table 1 confirm that the belts prepared in Examples achieve higher transferability than the belts prepared in Comparative examples even when a recording medium having large surface irregularities is used.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A belt capable of holding a toner image, the belt being used for an image forming apparatus, the belt comprising:

a multilayer structure including a surface layer defining an outer peripheral surface of the belt, the belt having a 5 seconds volume resistivity at 100 V of 10.0 log Ω·cm or more and 12.5 log Ω·cm or less, the 5 seconds volume resistivity at 100 V being measured after a lapse of 5 seconds since start of application of a voltage of 100 V, the outer peripheral surface of the belt having a 3 seconds surface resistivity at 100 V of more than 11.0 log Ω/sq and 13.5 log Ω/sq or less, the 3 seconds surface resistivity at 100 V being measured after a lapse of 3 seconds since start of application of a voltage of 100 V, the difference between a 1 seconds surface resistivity of the outer peripheral surface of the belt at 100 V and a 100 seconds surface resistivity of the outer peripheral surface of the belt at 100 V being 0.5 or less, the 1 seconds surface resistivity being measured after a lapse of 1 second since start of application of a voltage of 100 V, the 1 seconds surface resistivity being measured after a lapse of 100 seconds since start of application of a voltage of 100 V.

2. The belt according to claim 1, wherein the surface layer includes at least one selected from the group consisting of a polyimide resin and a polyamideimide resin.

3. The belt according to claim 2, wherein the surface layer is composed of a polyimide resin.

4. The belt according to claim 1, wherein the surface layer includes carbon black.

5. The belt according to claim 2, wherein the surface layer includes carbon black.

6. The belt according to claim 4, wherein an amount of the carbon black is 10% by mass or more and 22% by mass or less of a total mass of the surface layer.

7. The belt according to claim 5, wherein an amount of the carbon black is 10% by mass or more and 22% by mass or less of a total mass of the surface layer.

8. The belt according to claim 6, wherein the carbon black has an average primary particle size of 2 nm or more and 20 nm or less.

9. The belt according to claim 7, wherein the carbon black has an average primary particle size of 2 nm or more and 20 nm or less.

10. The belt according to claim 1, wherein the belt has an overall thickness of 60 μm or more and 120 μm or less.

11. The belt according to claim 2,
wherein the belt has an overall thickness of 60 μm or more and 120 μm or less.

12. The belt according to claim 3,
wherein the belt has an overall thickness of 60 μm or more and 120 μm or less.

13. The belt according to claim 10,
wherein the thickness of the surface layer is 3% or more and 50% or less of the overall thickness of the belt.

14. The belt according to claim 11,
wherein the thickness of the surface layer is 3% or more and 50% or less of the overall thickness of the belt.

15. The belt according to claim 12,
wherein the thickness of the surface layer is 3% or more and 50% or less of the overall thickness of the belt.

16. The belt according to claim 1,
wherein the multilayer structure includes a base layer arranged adjacent to the surface layer.

17. The belt according to claim 2,
wherein the multilayer structure includes a base layer arranged adjacent to the surface layer.

18. The belt according to claim 3,
wherein the multilayer structure includes a base layer arranged adjacent to the surface layer.

19. An intermediate transfer belt comprising the belt according to claim 1.

20. An image forming apparatus comprising the belt according to claim 1.

* * * * *